US009061497B2

(12) United States Patent
Okubo

(10) Patent No.: US 9,061,497 B2
(45) Date of Patent: Jun. 23, 2015

(54) LIQUID EJECTING HEAD AND LIQUID EJECTING APPARATUS

(71) Applicant: Seiko Epson Corporation, Tokyo (JP)

(72) Inventor: Katsuhiro Okubo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/163,424

(22) Filed: Jan. 24, 2014

(65) Prior Publication Data

US 2014/0240401 A1 Aug. 28, 2014

(30) Foreign Application Priority Data

Feb. 22, 2013 (JP) ..... 2013-033768

(51) Int. Cl.
*B41J 2/14* (2006.01)
*B41J 2/16* (2006.01)
*B41J 2/175* (2006.01)

(52) U.S. Cl.
CPC ..... *B41J 2/1433* (2013.01); *B41J 2/17523* (2013.01)

(58) Field of Classification Search
None
See application file for complete search history.

(56) References Cited

U.S. PATENT DOCUMENTS

2002/0196318 A1* 12/2002 Shimizu ..... 347/85
2003/0151645 A1* 8/2003 Yamada et al. ..... 347/47
2008/0043059 A1 2/2008 Okazawa et al.

FOREIGN PATENT DOCUMENTS

JP 2003-305873 A 10/2003
JP 2009-006730 A 1/2009

* cited by examiner

*Primary Examiner* — Lisa M Solomon

(57) ABSTRACT

A liquid ejecting head includes: a first-member that has a first liquid-flow-path and discharges liquid in the first liquid-flow-path from a nozzle; a second-member that has a second liquid-flow-path communicating with the first liquid-flow-path; a seal-member that seals a coupling portion between the first liquid-flow-path of the first-member and the second liquid-flow-path of the second-member; and a support-member that is fixed to the first-member at a fixing area side which is located in a position different from a position where the nozzle is located when a plane in which the nozzle is formed is seen from above. The support-member is supported at the fixing area and projects toward the coupling portion, and supports, at a coupling portion side, the seal member at a first-member-side of the seal-member. The seal-member seals the coupling portion by applying pressure in a diameter direction of the first liquid-flow-path.

20 Claims, 11 Drawing Sheets

LIQUID EJECTING HEAD AND LIQUID EJECTING APPARATUS

CROSS REFERENCE TO RELATED APPLICATION

This application claims priority to Japanese Patent Application No. 2013-033768 filed on Feb. 22, 2013. The entire disclosure of Japanese Patent Application No. 2013-033768 is hereby incorporated herein by reference.

BACKGROUND

1. Technical Field

The present invention relates to an ink jet recording head which ejects liquid from a nozzle and a liquid ejecting apparatus. More specifically, the invention relates to an ink jet recording head for ejecting ink as liquid and an ink jet recording apparatus.

2. Related Art

A representative example of the liquid ejecting head that ejects liquid droplets includes an ink jet recording head that ejects ink droplets. As the ink jet recording head, the one which has a head body that ejects ink droplets from a nozzle and a flow path member which supplies ink from a liquid storage, such as an ink cartridge, which is fixed to the head body and in which ink is accumulated to each head body has been proposed (see JP-A-2009-6730).

A flow path member in such an ink jet recording head has a first flow path member which holds a plurality of head bodies and a second flow path member that is fixed to an opposite side of a surface to which the head body of the first flow path member is fixed. Then, a seal member composed of a plate-like elastic material such as a sheet is pinched between an opening end portion of a flow path of the first flow path member and an opening end portion of a flow path of the second flow path member so as to prevent ink leakage from the coupled flow paths.

However, when the flow path of the first flow path member and the flow path of the second flow path member are sealed by the seal member such as rubber sheet which is pinched between the two members, pressure is applied due to repulsive force as a result of elastic deformation of the seal member in a direction in which the first flow path member and the second flow path member are separated from each other. Thus, pressure is applied in a vertical direction to the liquid ejecting surface for ejecting ink droplets of the head body to cause detachment of the head body from the flow path member, detachment of a stacked member which configures the head body, and deflection of the liquid ejecting surface of the head body. Accordingly, there arises a problem that a failure such as deviation of landing position of droplets occurs.

Further, when an elastic force of the seal member is set to be small, a seal property of the seal member is reduced. Then, there causes a fear of ink leakage and so forth from a coupling portion between the flow paths.

Note that such problems exist not only in the ink jet recording head but also in the liquid ejecting head that ejects liquid other than ink.

SUMMARY

An advantage of some aspects of the invention is to provide a liquid ejecting head in which flow paths are suitably coupled and a liquid ejecting apparatus.

According to an aspect of the invention, a liquid ejecting head includes: a first member that has a first liquid flow path and ejects liquid in the first liquid flow path from a nozzle; a second member that has a second liquid flow path communicating with the first liquid flow path; a seal member that seals a coupling portion between the first liquid flow path of the first member and the second liquid flow path of the second member; and a support member that is fixed to the first member and supports the seal member. The support member is fixed to the first member at a fixing area side which is located in a position different from a position where the nozzle is located when a plane in which the nozzle is formed is seen from above. The support member is supported at the fixed area and protrudes toward the coupling portion, and supports the seal member at a first member side of the seal member at a coupling portion side. In the liquid ejecting head, the seal member seals the coupling portion by applying pressure in a diameter direction of the first liquid flow path.

According to this aspect, the seal member is supported by the support member, thereby being capable of suppressing repulsive force due to elastic deformation of the seal member to be applied in a direction orthogonal to the liquid ejecting surface. Further, even if pressure is applied at the time of mounting a liquid storage, pressure applied to the coupling portion by the support member is dispersed toward the fixing area side, whereby the pressure to be applied to the nozzle can be suppressed. Further, pressure that seals a first liquid flow path side with the seal member is applied in a diameter direction of the liquid flow path, thereby being capable of suppressing repulsive force due to elastic deformation of the seal member to be applied in a direction orthogonal to the liquid ejecting surface. Further, the support member supports the seal member at the first member side of the seal member means that the first liquid flow path is provided further toward the first member side than a portion of the seal member that is supported at least by the support member. On a part of the seal member, there may be a portion extending further toward the first member side than the supporting member.

It is preferable that the support member and the second member be fixed at an area inner than an area where the support member and the first member are fixed. According to this configuration, it is possible to improve stiffness of the support member, thereby being capable of suppressing pressure to be applied to the nozzle due to deformation of the support member.

It is preferable that the seal member seal a portion between the support member and the second member by applying pressure in a direction which intersects a diameter direction of the second liquid flow path. According to this configuration, by applying pressure, of the seal member that seals the second liquid flow path side, in a diameter direction of the liquid flow path, it is possible to further suppress repulsive force due to elastic deformation of the seal member to be applied in a direction orthogonal to the liquid ejecting surface.

It is preferable that the liquid ejecting head further include a head body which has a nozzle plate, and the fixing area be on an outside of the nozzle plate when a plane in which the nozzle is formed is seen from above. According to this configuration, even if an area of the nozzle plate of the head body 10 is small and an area on the side opposite to the nozzle plate of the head body 10 is large, it is possible to suppress repulsive force due to elastic deformation of the seal member to be applied in a direction orthogonal to the liquid ejecting surface. Further, the fixing area may be an area where the first member and the second member are fixed. Further, the first member and the support member may be integrated with each other. Furthermore, the first member and the support member may be different members. Moreover, the support member and the seal member may be bonded with adhesive.

Further, according to another aspect of this invention, a liquid ejecting apparatus includes the liquid ejecting head according to the above aspects.

According to this aspect, it is possible to realize a liquid ejecting apparatus which suppresses liquid leakage and avoids deviation of landing position of liquid and destructive damage to the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, this invention will be explained in detail based on the embodiments.

First Embodiment

Figure 1:
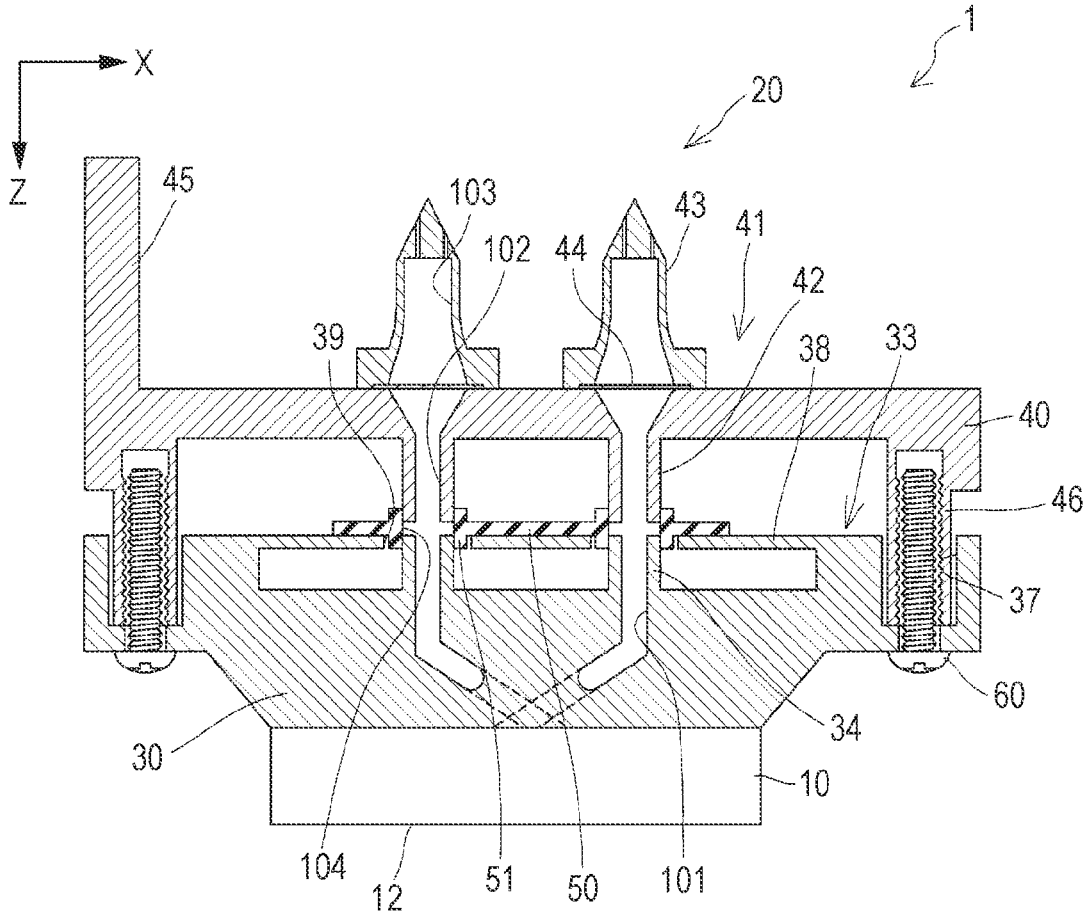
FIG. 1 is a section view of a recording head according to a first embodiment of this invention.
Figure 2:
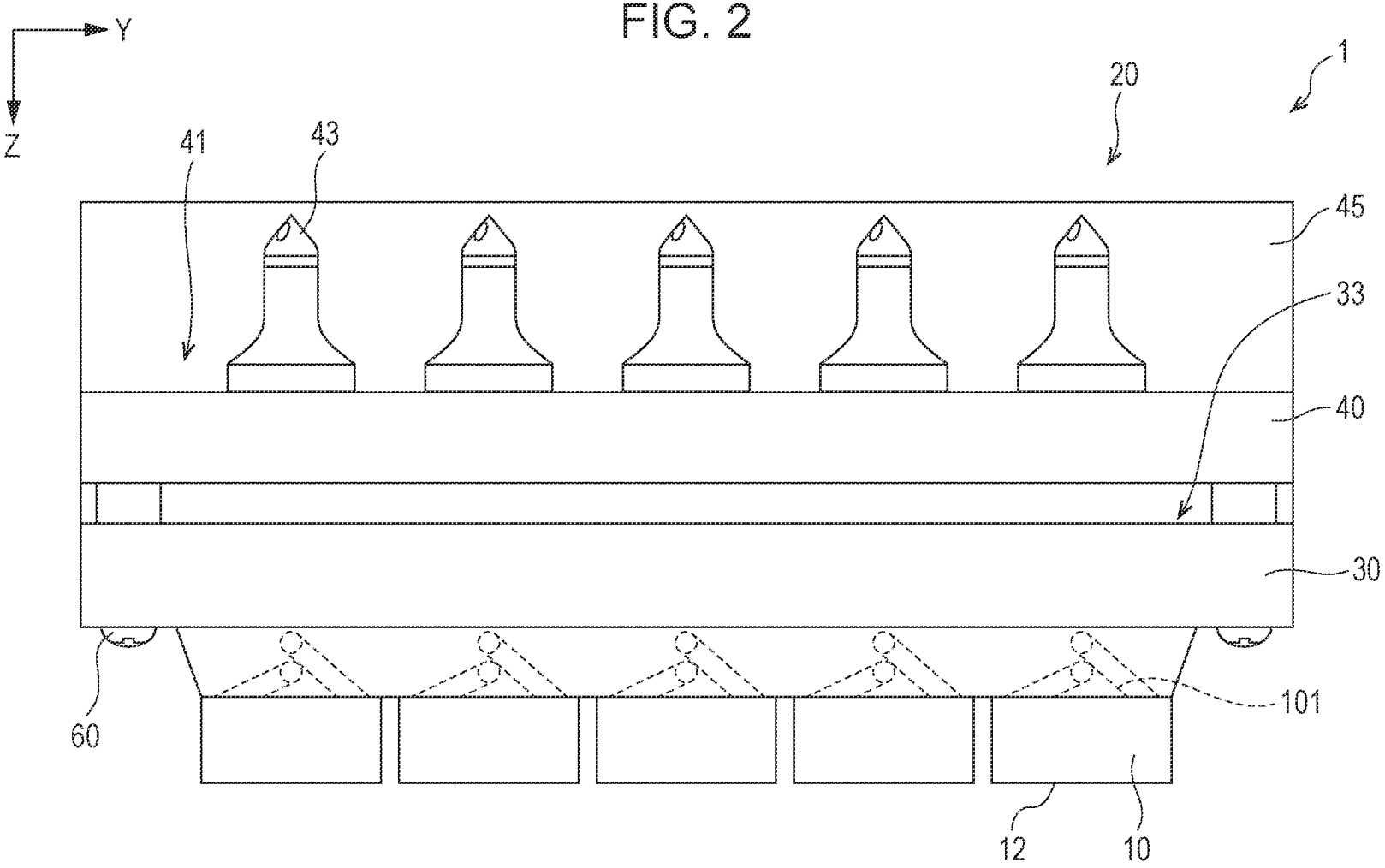
FIG. 2 is a front view of a recording head according to the first embodiment of this invention.
Figure 3A:
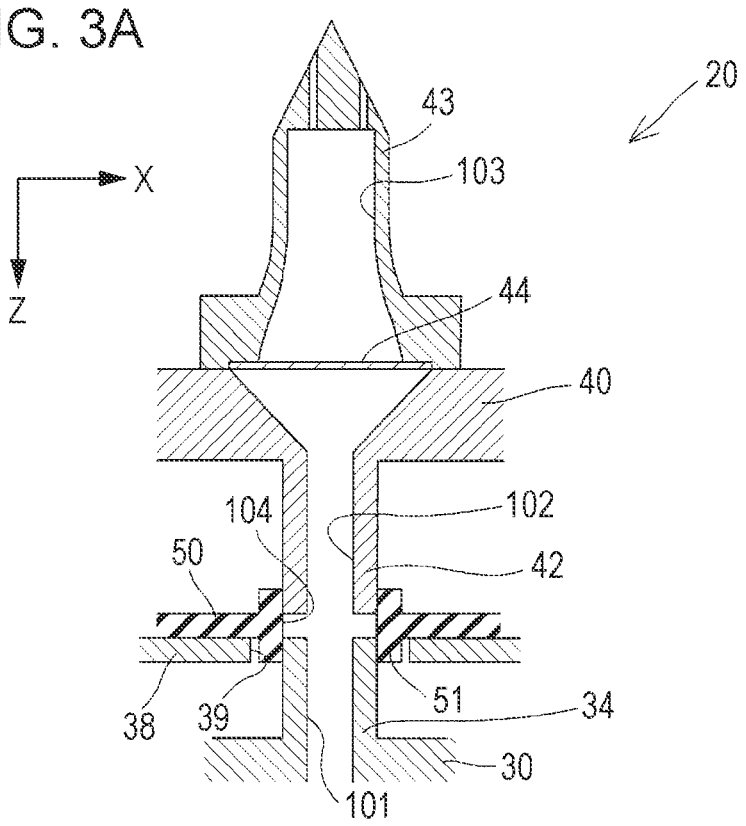
FIG. 3A and FIG. 3B are enlarged section views of a main portion of the recording head according to the first embodiment of this invention.
Figure 3B:
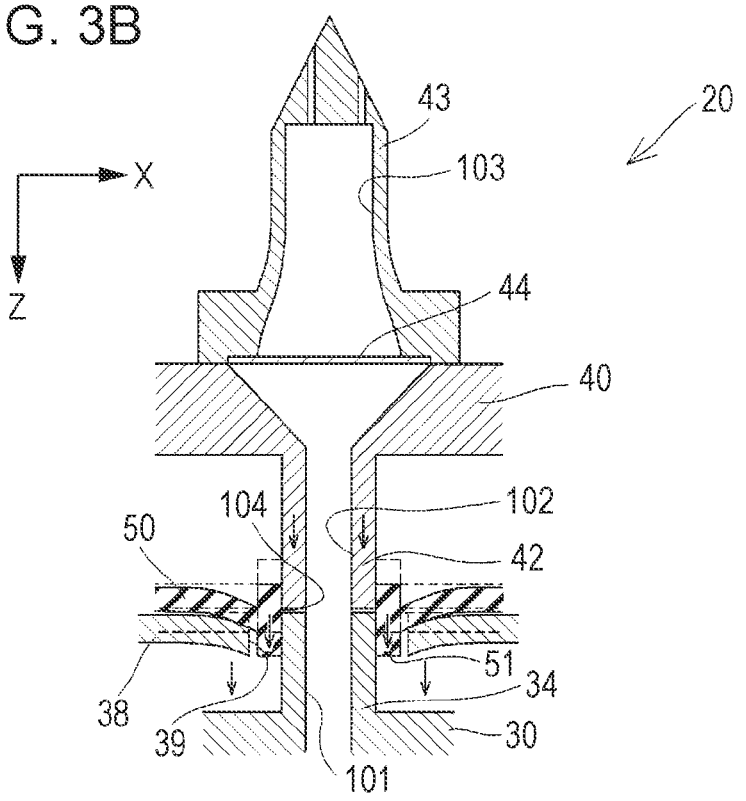

FIG. 1 is a section view of an ink jet recording head as an example of a liquid ejecting head according to a first embodiment of this invention. FIG. 2 is a front view (a projection view in a first direction X) of the recording head and FIG. 3A and FIG. 3B are enlarged section views of a main portion of FIG. 1.

As illustrated in the drawings, an ink jet recording head 1 as an example of the liquid ejecting head according to this embodiment has a plurality of head bodies 10 that eject ink droplets from a nozzle and a flow path member 20 which holds the plurality of head bodies 10 and includes a liquid flow path that supplies liquid to the head bodies 10.

Each head body 10 has on one side surface thereof a liquid ejecting surface 12 which has an opening for a nozzle that ejects ink droplets as liquid. The liquid ejecting surface 12 of this embodiment has two nozzle rows in each of which nozzles are arranged in a direction which intersects a direction in which the nozzle rows are arranged in parallel. Here, in this embodiment, a direction in which nozzles are arranged in one nozzle row is referred to as a first direction X and a direction which intersects the first direction X and in which nozzle rows are arranged is referred to as a second direction Y.

Inside (not shown) of the head body 10, a flow path which communicates with the nozzles and communicates with a liquid flow path of the flow path member 20 and a pressure generator for causing pressure change in ink in the flow path are provided. The pressure generator such as the one which ejects ink droplets from a nozzle by changing flow path volume due to change in the shape of a piezoelectric actuator which has piezoelectric material having electrical/mechanical conversion function to cause pressure change in ink in the flow path; the one which ejects ink droplets from a nozzle by arranging a heating device in the flow path and generating bubbles by heat of the heating device to eject ink; and a so-called electrostatic actuator which ejects ink droplets from a nozzle by causing electrostatic force between a vibration plate and electrode to deform the vibration plate due to the electrostatic force are cited.

In such head body 10, an opposite surface side of the liquid ejecting surface 12 is fixed to the flow path member 20. Then, ink which has been accumulated in a liquid storage such as an ink cartridge or an ink tank is supplied via the flow path member 20. Further, in the flow path member 20, a plurality of head bodies 10 (5 in this embodiment) are set in parallel and fixed in the second direction Y that is a direction of the nozzle rows. Meanwhile, in this embodiment, a direction in which the flow path member 20 and the head body 10 are fixed (a fixing direction) is referred to as a third direction Z. That is, the fixing direction of the flow path member 20 and the head body 10 is a stacking direction and a direction perpendicular to a surface direction of the liquid ejecting surface 12 (a surface direction of the first direction X and the second direction Y).

Here, a fixing method of the head body 10 and the flow path member 20 is not particularly limited, for instance, bonding with adhesive or fixing with a screw and so forth are cited. Note that since the head body 10 is small in size and fixing with a screw via a seal member is difficult, bonding with adhesive is preferable.

The flow path member 20 to which such head body 10 is fixed includes a first flow path member 30 in which a first liquid flow path 101 is provided, a second flow path member 40 in which a second liquid flow path 102 communicating with the first liquid flow path 101 is provided, and a seal member 50 which is provided between the first flow path member 30 and the second flow path member 40 and seals a coupling portion between the first liquid flow path 101 and the second liquid flow path 102.

In one surface (in the third direction Z) of the first flow path member 30, five head bodies 10 are set in parallel in the second direction Y, as described above.

Another surface, of the first flow path member 30, opposite to the surface where the head bodies 10 are fixed is a second flow path member mounting portion 33 to which the second flow path member 40 is fixed.

Further, the first liquid flow path 101 is provided in the first flow path member 30. In the first liquid flow path 101, one end is opened to the second flow path member mounting portion 33 and the other end is opened to a surface to which the head body 10 is fixed.

Further, on the second flow path member mounting portion 33 in which the first liquid flow path 101 is opened, a cylinder-shaped first projection portion 34 is provided. On an end surface of the first projection portion 34, the first liquid flow path 101 is provided and opened.

Further, as illustrated in FIG. 2, on the first flow path member 30, two first liquid flow paths 101 are provided for one head body 10. In this embodiment, five head bodies 10 are provided on the first flow path member 30. Therefore, ten first liquid flow paths 101 are provided in total.

Further, on the first flow path member 30, fixing holes 37 which penetrate through the first flow path member 30 in a thickness direction are provided. By screwing a fixing screw 60 in a state where a fixing portion 46 provided on the second flow path member 40 is inserted into the fixing hole 37, the second flow path member 40 is fixed to the first flow path member 30.

The second flow path member 40 to be fixed to the first flow path member 30 includes, on a side opposite to a surface where the first flow path member 30 is fixed, a liquid storage mounting portion 41 to which liquid storage like an ink cartridge and so forth that accumulates ink are coupled.

Further, the second flow path member 40 has, at one end in the first direction X, a wall portion 45 which extends to a side of the liquid storage mounting portion 41 in the third direction Z.

On the second flow path member 40, a second liquid flow path 102 in which one end is opened to a side of the liquid storage mounting portion 41 and the other end is opened to a side of the first flow path member 30 (opened to the second flow path member mounting portion 33) is provided. In this embodiment, since the second liquid flow path 102 is coupled to the first liquid flow path 101 of the first flow path member 30, the same number with that of the first flow path 101, that is, ten second liquid flow paths 102 are provided.

Further, on a surface, which faces the first flow path member 30, of the second flow path member 40, a cylinder-shaped second projection portion 42 is provided. The second liquid flow path 102 is provided and opened on a projecting top surface of the second projection portion 42. That is, on the surface, which faces the first flow path member 30, of the second flow path member 40, a plurality of tube-shaped second projection portions 42 in which the second liquid flow path 102 is each provided are provided in a projecting manner.

Further, on a surface, which is opposite to the surface facing the first flow path member 30, of the second flow path member 40, that is, a portion opened for the second liquid flow path 102 in the liquid storage mounting portion 41, a needle-shaped coupling member 43 to be coupled to the liquid storage is fixed via a filter 44 for removing bubbles and obstacles that are included in ink.

The coupling member 43 has a through-hole 103 which communicates with the second liquid flow path 102. Then, by coupling the coupling member 43 to the liquid storage, ink in the liquid storage is supplied to the second liquid flow path 102 of the second flow path member 40 via the through-hole 103 of the coupling member 43. Further, in this embodiment, since an ink cartridge is used as the liquid storage, by inserting the needle-shaped coupling member 43 into the ink cartridge, the inside of the ink cartridge and the through-hole 103 inside the coupling member 43 are coupled. Further, the coupling member 43 is provided so as to correspond to the second liquid flow path 102. Accordingly, in this embodiment, since ten second liquid flow paths 102 are provided, ten, that is, the same number with that of the second liquid flow path 102, of the coupling members 43 are provided.

Further, on the second flow path member 40, the fixing portion 46 to be inserted into the fixing hole 37 of the first flow path member 30 is provided in a projecting manner. In this embodiment, on each of four corners, the fixing portion 46 is provided respectively. Further, four fixing holes 37 of the first flow path member 30 are provided, similarly to the fixing portions 46.

In such second flow path member 40, positioning is performed by inserting the fixing portion 46 into the fixing hole 37 of the first flow path member 30. Then, a fixing screw 60 is inserted from an opposite side to the second flow path member 40 into the fixing hole 37 of the first flow path member 30 to screw the fixing screw 60 with the fixing portion 46 of the second flow path member 40, thereby fixing the second flow path member 40 to the first flow path member 30.

Note that, in this embodiment, the head body 10 and the first flow path member 30 correspond to the first member which ejects ink and in which the first liquid flow path 101 is provided and the second flow path member 40 corresponds to the second member in which the second liquid flow path 102 that communicates with the first liquid flow path 101 is provided.

Further, between the first flow path member 30 and the second flow path member 40, the seal member 50 that seals a coupling portion between the first liquid flow path 101 and the second liquid flow path 102 is provided. Here, a coupling portion between the first liquid flow path 101 and the second liquid flow path 102 is a portion where the first projection portion 34 and the second projection portion 42 face each other. When a top surface of the first projection portion 34 and that of the second projection portion 42 are made to contact directly, there may generate a gap between the first projection portion 34 and the second projection portion 42 due to dimension tolerance and so forth or the first projection portion 34 and the second projection portion 42 abut each other to apply pressure in the third direction Z to the head body 10. Therefore, the top surface of the first projection portion 34 and that of the second projection portion 42 are arranged to be separated in advance. Further, when there is a gap between the first projection portion 34 and the second projection portion 42, there is a fear of staying of bubbles. Therefore, a filling member may be placed between the first projection portion 34 and the second projection portion 42. As this filling member, a porous elastomer having a liquid-resistance property against liquid such as ink or the like which is used in the ink jet recording head 1, and whose elastic force (elastic ratio) is low in comparison with the seal member 50 (described later in detail) can be used. For instance, as a porous elastomer, a resin material such as polyethylene, melanin, or sponge made of rubber is cited.

As the seal member 50, a material which has a liquid-resistance property against liquid such as ink and so forth used in the ink jet recording head 1 and is elastically deformable, for instance, rubber, elastomer and so forth can be used. In this embodiment, a plate-like member made of rubber is used as the seal member 50.

Further, on the seal member 50, a cylinder-shaped seal portion 51 is provided integrally. On the seal portion 51, a communication path 104 which has a slightly smaller inner diameter than an outer diameter of the first projection portion 34 and the second projection portion 42 is provided. Then, by fitting the communication path 104 of the seal portion 51 with outer peripheries of the first projection portion 34 and the second projection portion 42, the first liquid flow path 101 provided on the first projection portion 34 and the second liquid flow path 102 provided on the second projection portion 42 communicate with each other via the communication path 104. That is, on the outer peripheries of the first projection portion 34 and the second projection portion 42, the seal portion 51 which is provided over the outer peripheries of the first projection portion 34 and the second projection portion 42 and continues around a circumferential direction of a boundary is provided. Further, a plurality of seal portions 51 are integrally provided consecutively as a plate-like member.

Further, the communication path 104 has a slightly smaller inner diameter than the outer diameters of the first projection portion 34 and the second projection portion 42. Therefore, the inside of the communication path 104 is made to stick to each of outer peripheries of the first projection portion 34 and the second projection portion 42 in a state where pressure is applied in a diameter direction of the first liquid flow path 101 and the second liquid flow path 102. Here, a diameter direction of the first liquid flow path 101 and the second liquid flow path 102 is a direction which traverses a direction of ink flow. In this embodiment, it is a surface direction along the first direction X and the second direction Y. Though the first liquid flow path 101 and the second liquid flow path 102 are provided along the third direction Z in this embodiment, this is not particularly limited thereto. For instance, either one of the first liquid flow path 101 and the second liquid flow path 102 or both of them may be provided in a direction which intersects the third direction Z. In this case, in the seal portion 50, a diameter direction of the first liquid flow path 101 and the second liquid flow path 102 is a direction which intersects the third direction Z in which the flow path is provided.

Thus, with the seal member 50 that applies pressure for sealing in a diameter direction of the first liquid flow path 101 and the second liquid flow path 102, the first liquid flow path 101 and the second liquid flow path 102 are communicated, thereby being capable of suppressing actions that the seal member 50 elastically deforms in a direction orthogonal to a surface direction of the liquid ejecting surface 12, that is, the third direction Z and the repulsive force presses the head body 10. Thus, it is possible to suppress detachment of the head body 10 from the flow path member 20, detachment of a stacking member (not shown) which configures the head body 10 (a member stacked in the third direction Z) and deflection of the liquid ejecting surface 12 of the head body 10, thereby being capable of suppressing shift of landing positions of ink droplets ejected from a nozzle to the ink-droplet ejected medium due to deflection of the liquid ejecting surface 12.

Here, when the seal member composed of an elastic member is pinched between the top surface of the first projection portion 34 and the top surface of the second projection portion 42, pressure is applied to the head body 10 in a direction (third direction Z) perpendicular to a surface direction of the liquid ejecting surface 12 due to repulsive force as a result of elastic deformation of the seal member. When pressure is applied to the head body 10 in the third direction Z, there causes landing failure of ink droplets to the ink-droplet ejected medium due to detachment of the head body 10 from the flow path member 20, detachment of a stacking member (a member stacked in the third direction Z, not shown) which configures the head body 10, and deflection of the liquid ejecting surface 12 of the head body 10.

Further, pressure to seal the seal member 50 is applied in a diameter direction of the first liquid flow path 101 and the second liquid flow path 102, thereby increasing the sealing pressure of the seal member 50. Note that when the seal member composed of an elastic member is pinched between the top surface of the first projection portion 34 and the top surface of the second projection portion 42, pressure due to repulsive force when the seal member elastically deforms is applied to the head body 10. Therefore, it is not possible to increase the pressure for pinching the seal member. Further, when the pressure for pinching the seal member is lowered, there is a fear of causing ink leakage. In this embodiment, pressure to seal the seal member 50 is applied in a diameter direction of the first liquid flow path 101 and the second liquid flow path 102, thereby being capable of suppressing breakage of the head body 10 and deflection of the liquid ejecting surface 12 even when the sealing pressure of the seal member 50 is increased to suppress ink leakage.

In this embodiment, on the first flow path member 30, a support member 38 is provided. The support member 38 is made of a material which is elastically deformable, for instance, resin, metal, and so forth.

Further, the support member 38 is supported at a fixing area side where the first flow path member 30 and the second flow path member 40 are fixed and is provided projecting toward the coupling portion between the first liquid flow path 101 and the second liquid flow path 102. The support member 38 is provided, at this coupling portion side, abutting against a surface of the seal member 50 on the head body 10 side. Further, the support member 38 and the seal member 50 are bonded with adhesive so that the seal member 50 may not be detached from a portion between the first projection portion 34 and the second projection portion 42. Of course, a fitting structure may be adopted in the support member 38 to fix the seal member 50, and other methods such as a fitting method may be adopted to seal the seal member 50.

Here, in this embodiment, as described above, the first flow path member 30 and the second flow path member 40 are fixed by screwing the fixing screw 60 with the fixing portion 46 that has been inserted into the fixing hole 37 of the first flow path member 30. Therefore, the fixing area where the first flow path member 30 and the second flow path member 40 are fixed is an area where the fixing portion 46 is fixed with the fixing screw 60.

Then, when a plane where a nozzle is formed is seen from above, this fixing area is provided in a place different from the place where a nozzle is formed. In this embodiment, the fixing area is, when the liquid ejecting surface is seen from above, arranged on the outside of the liquid ejecting surface 12 where a nozzle is opened, that is, the outside of the head body 10. Since a nozzle is generally provided on a nozzle plate, for instance, when an area of the nozzle plate of the head body 10 is small and a surface of the head body 10 opposite the nozzle plate is large, as long as the fixing area is arranged outside the nozzle plate, the fixing area may be arranged on a position overlapping the side of the head body 10 opposite the nozzle plate. Further, though described later in detail, if the fixing area is made to be at a position different from a position where the nozzle is formed and pressure when the support member 38 supports the seal member 50 is applied to the fixing area, it is possible to suppress the pressure to be applied to the liquid ejecting surface 12. Even if the fixing area is within the liquid ejecting surface 12, when the fixing area is arranged on a position different from the position where the nozzle is formed, it is possible to suppress detachment around the nozzle though an end portion of a nozzle plate, etc. is detached in some cases.

Therefore, the support member 38 is supported at a side where the fixing hole 37 is provided. In this embodiment, by using a plate-like support member 38, in a surface along the first direction X and the second direction Y, the first flow path member 30 and the support member 38 are integrated around a circumferential direction on the outer circumferential side of the first flow path member 30, whereby the support member 38 is supported by the first flow path member 30. Further, on the support member 38, an insertion hole 39 for inserting the first projection portion 34 is provided, and the support member 38 is provided in a state of being separated from the first flow path member 30 in a central portion of the first flow path member 30. Thus, the support member 38 supports a surface, on a side of the first flow path member 30, of the seal member 50. That is, the support member 38 abuts against a surface of the seal member 50, the surface facing the first flow path member 30.

By providing the support member 38 as described above, as illustrated in FIG. 3A and FIG. 3B, even if pressure is applied to the second flow path member 40 at the time of mounting the liquid storage, pressure due to mounting of the liquid storage is dispersed by the support member 38. Thus, it is possible to suppress pressure applied to the first projection portion 34.

As described above, when the liquid storage is mounted in the second flow path member 40, pressure is applied to the second flow path member 40 due to the mounting. This pressure is transmitted to the first projection portion 34 due to friction between an inside of the communication path 104 of the seal member 50 and the outer circumferential surfaces of the first projection portion 34 and the second projection portion 42. However, a surface of the head body 10 side of the seal member 50 is supported by the support member 38 which is elastically deformable. Therefore, by the coupling portion side of the support member 38 elastically deforming, pressure with which the second projection portion 42 presses the first projection portion 34 in the third direction Z via the seal member 50 is dispersed. That is, pressure with which the second projection portion 42 presses the seal member 50 is dispersed, by the support member 38 being elastically deformed, on the fixing area side at which the second flow path member 40 and the first flow path member 30 are fixed. Accordingly, pressure applied to the first projection portion 34 is reduced, thereby being capable of suppressing detachment of the head body 10 from the flow path member 20, detachment of a stacking member which configures the head body 10 and deflection of the liquid ejecting surface 12 due to pressing the first projection portion 34.

Further, in this embodiment, outer peripheries of the first projection portion 34 and the second projection portion 42 are made to have an approximately same outer diameter and the outer peripheries of the first projection portion 34 and the second projection portion 42 are fit with the seal member 50. However, this is not particularly limited thereto. Here, variations of the first projection portion 34, the second projection portion 42, and the seal member will be explained with reference to FIGS. 4A and 4B and FIGS. 5A and 5B. Note that FIGS. 4A and 4B and FIGS. 5A and 5B are section views and enlarged views thereof illustrating a variation of the recording head, respectively.

Figure 4A:
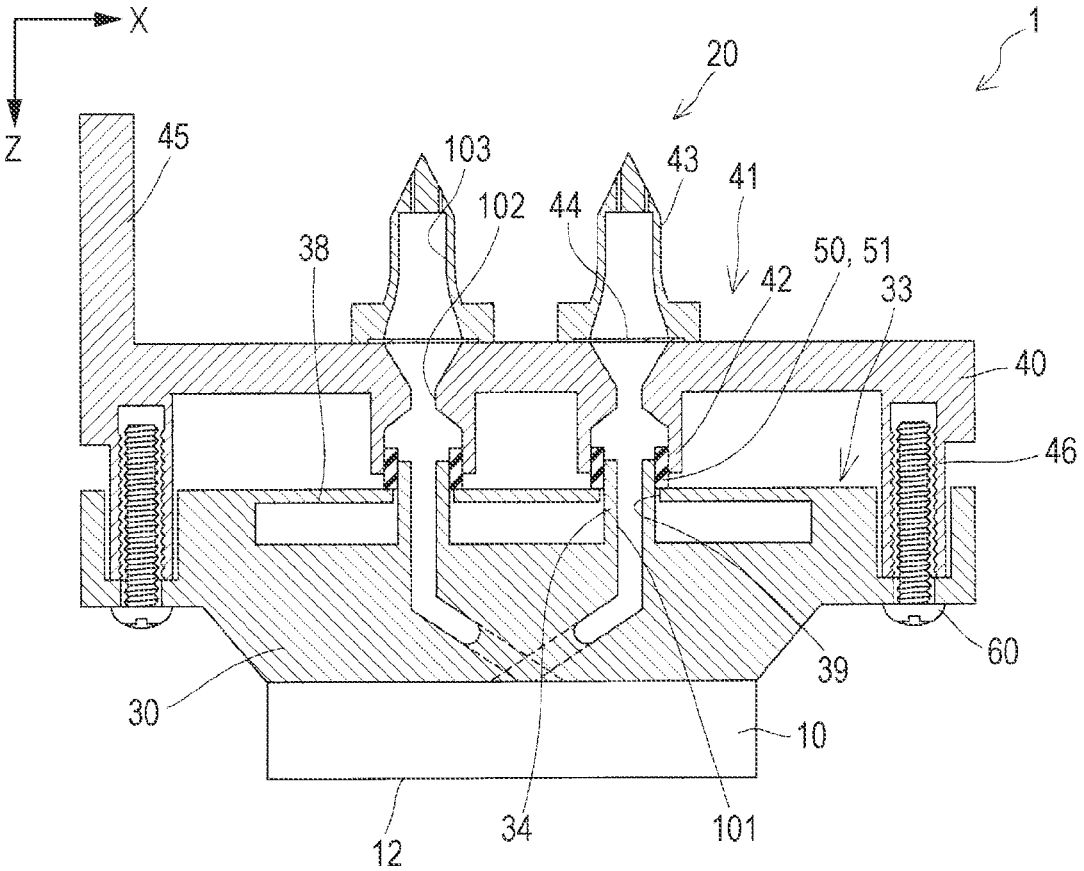
FIG. 4A and FIG. 4B are section views of a variation of the recording head according to the first embodiment of this invention.
Figure 4B:
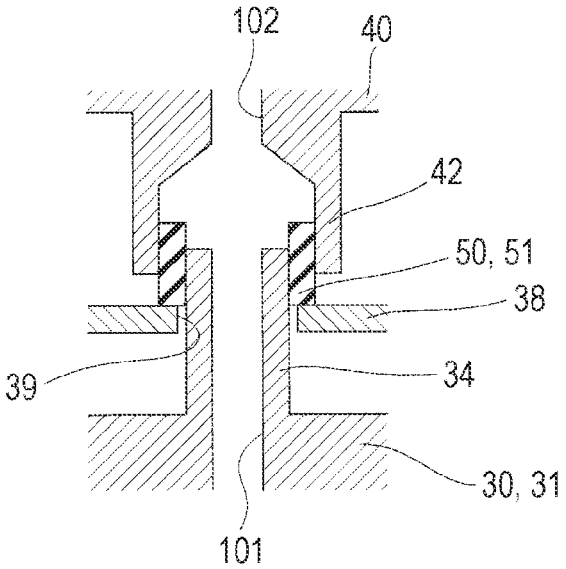

As illustrated in FIGS. 4A and 4B, the second projection portion 42 has a larger inner diameter than an outer diameter of the first projection portion 34. Then, between an outer periphery of the first projection portion 34 and an inner periphery of the second projection portion 42, the tube-shaped seal member 50 (seal portion 51) is provided. That is, the first projection portion 34 is inserted in the second projection portion 42. In this configuration, the seal member 50 also performs sealing by applying pressure in a diameter direction of the first liquid flow path 101 and the second liquid flow path 102. Then, a surface of the first flow path member 30 side (head body 10 side) of the seal member 50 is supported by the support member 38.

Figure 5A:
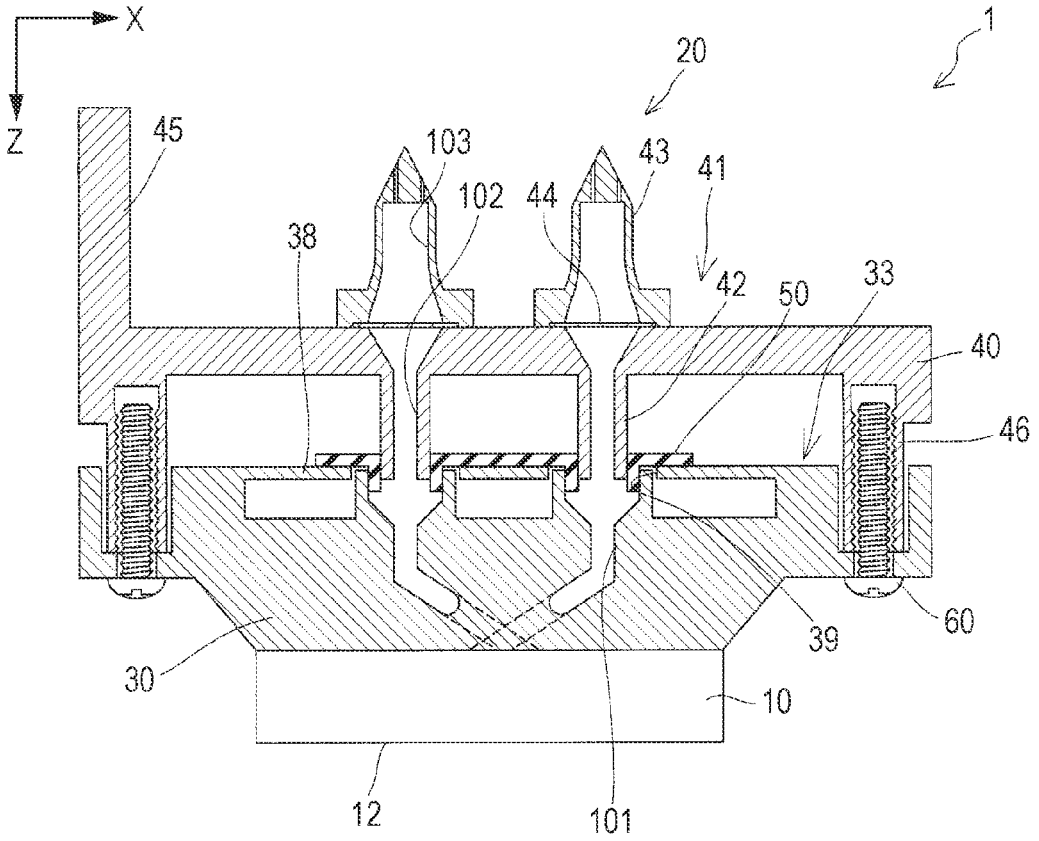
FIG. 5A and FIG. 5B are section views of a variation of the recording head according to the first embodiment of this invention.
Figure 5B:
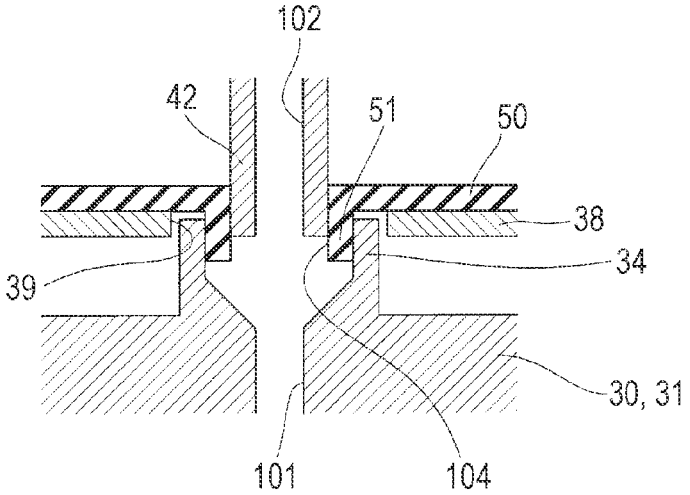

As illustrated in FIGS. 5A and 5B, the first projection portion 34 has a larger inner diameter than an outer diameter of the second projection portion 42. Then, between an outer periphery of the second projection portion 42 and an inner periphery of the first projection portion 34, the tube-shaped seal member 50 (seal portion 51) is provided. Further, the seal member 50 is extended, bending from an end portion of the second flow path member 40 side of the seal portion 51, to a surface direction (the first direction X and the second direction Y) of the liquid ejecting surface 12. Then, the support member 38 is provided to abut against a surface of the first flow path member 30 side on this extended surface. Even in this seal member 50, sealing is performed by applying pressure in a diameter direction of the first liquid flow path 101 and the second liquid flow path 102.

Further, in FIGS. 4A and 4B and FIGS. 5A and 5B, both of the first liquid flow path 101 and the second liquid flow path 102 are provided inside projection portions. However, a projection portion situated outside the seal portion 51 such as the second projection portion 42 in FIGS. 4A and 4B and the first projection portion 34 in FIGS. 5A and 5B may not be used. In FIGS. 4A and 4B, the second liquid flow path 102 may be provided in the second flow path member 40 without projecting and the first projection portion 34 and the seal portion 51 may be provided inside of the second liquid flow path 102. Similarly, in FIGS. 5A and 5B, the first liquid flow path 101 may be provided in the first flow path member 30 without projecting and the second projection portion 42 and the seal portion 51 may be provided inside of the first liquid flow path 101.

Further, though in this embodiment, the seal member 50 has a consecutive plate-like portion between the first projection portion 34 and the second projection portion 42, this is not particularly limited thereto. Here, another example of the seal member is illustrated in FIGS. 6A and 6B.

Figure 6A:
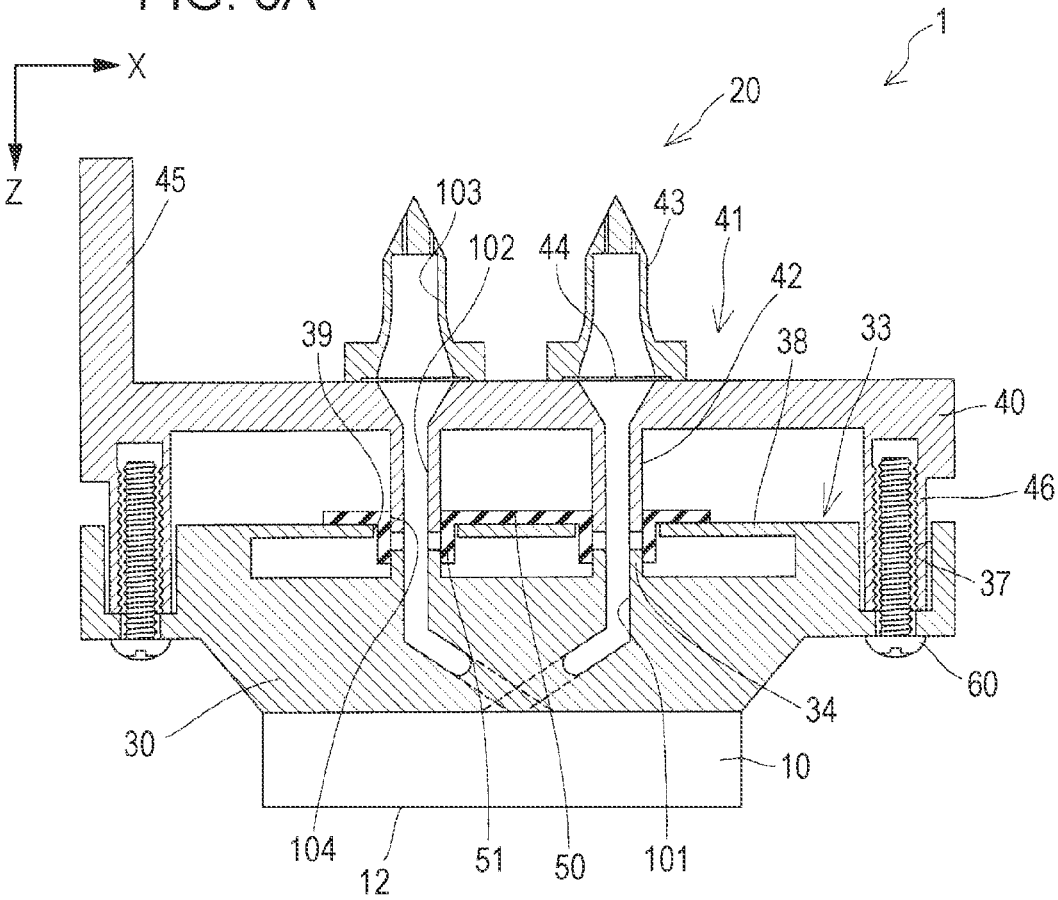
FIG. 6A and FIG. 6B are section views of a variation of the recording head according to the first embodiment of this invention.
Figure 6B:
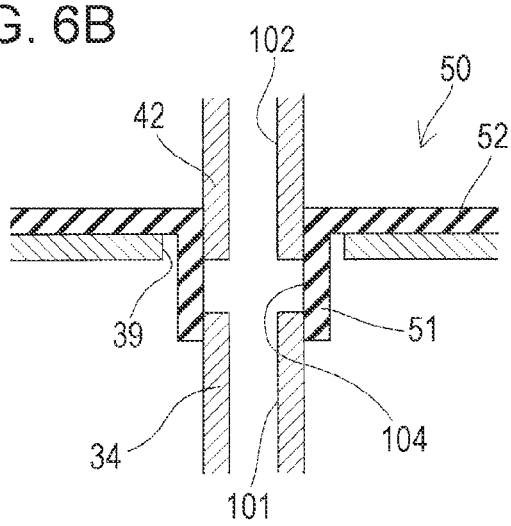

As illustrated in FIGS. 6A and 6B, the seal member 50 has a plate-like coupling portion 52 for coupling a plurality of seal portions 51 not between the first projection portion 34 and the second projection portion 42 but on an end portion of the first projection portion 34 side of the seal portion 51. According to this configuration, the coupling portion 52 is not provided in an area which faces a space portion between the first projection portion 34 of the cylinder-shaped seal member 51 and the second projection portion 42. Therefore, the seal member 51 is easy to elastically deform between the first projection portion 34 and the second projection portion 42. Therefore, assembly of the first flow path member 30, the second flow path member 40 and the seal member 50 is facilitated. Further, even if there causes a positional error between the first projection portion 34 and the second projection portion 42 (a position in a surface along the first direction X and the second direction Y), the seal portion 51 is easy to elastically deform. Therefore, it is possible to easily perform positioning and to suppress ink leakage. Further, at the time of attaching and detaching the liquid storage to and from the second flow path member 40, the seal portion 51 elastically deforms in an area between the first projection portion 34 and the second projection portion 42, thereby alleviating pressure at the time of attaching and detaching the liquid storage and the pressure is not readily transmitted to the second flow path member 40.

Second Embodiment

Figure 7:
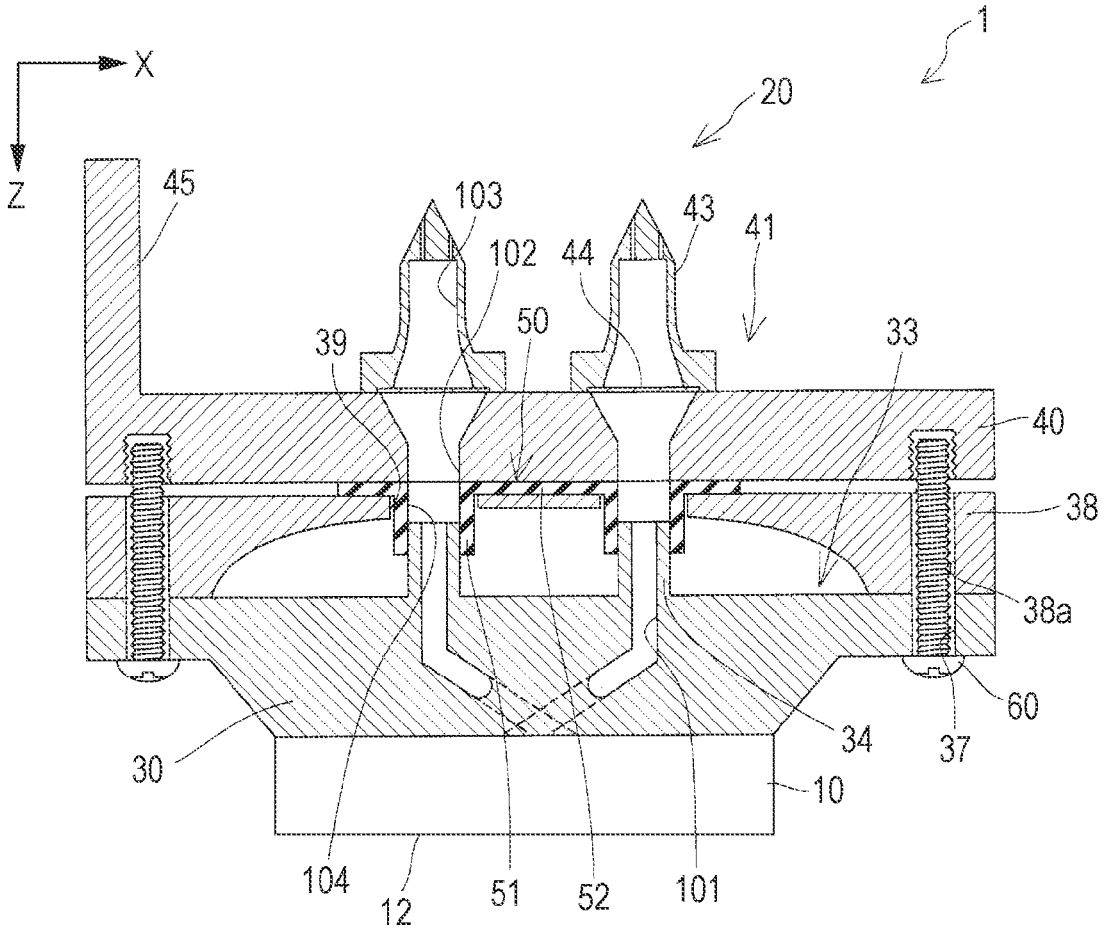
FIG. 7 is a section view of the recording head according to a second embodiment of this invention.
Figure 8:
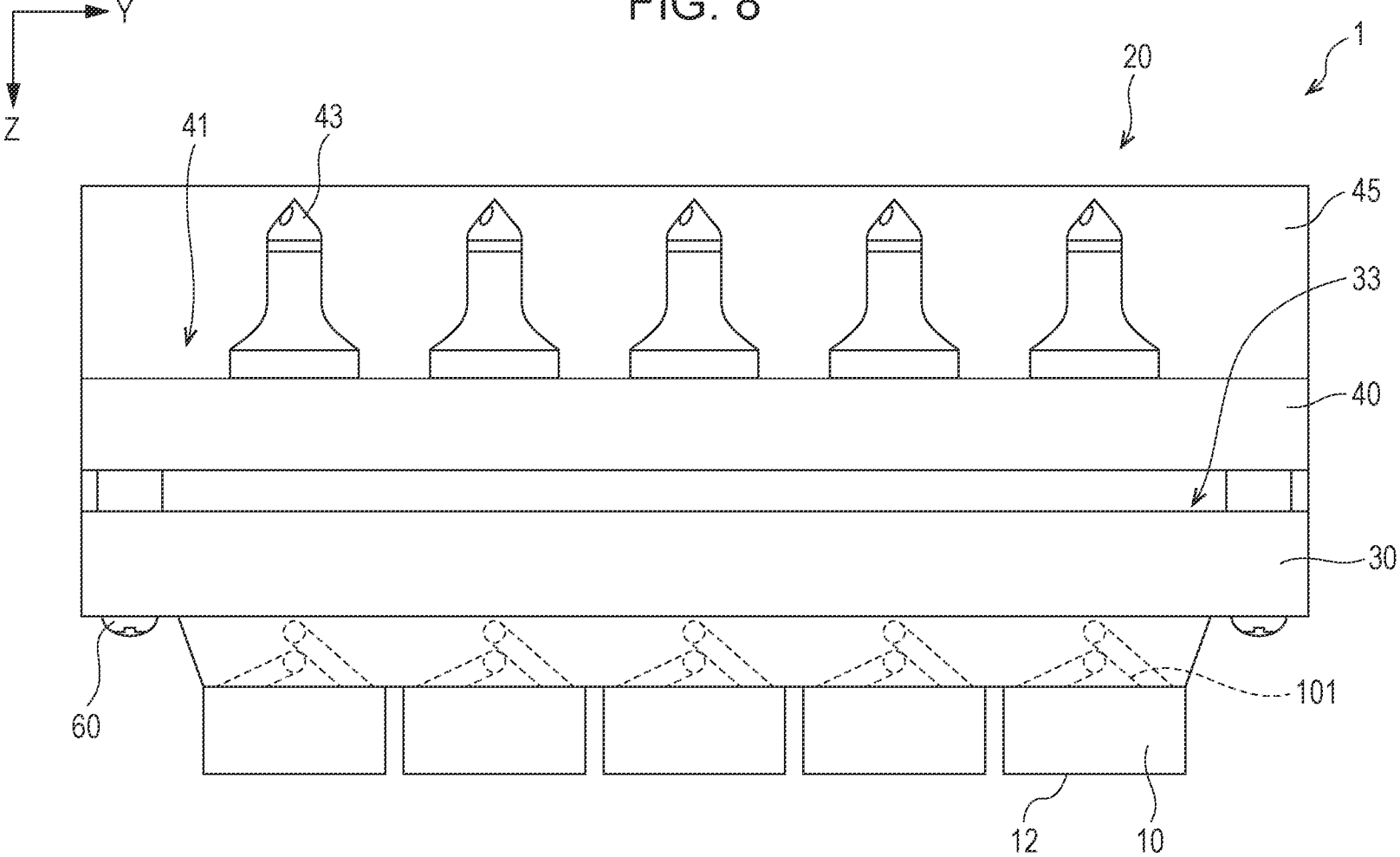
FIG. 8 is a front view of the recording head according to the second embodiment of this invention.
Figure 9A:
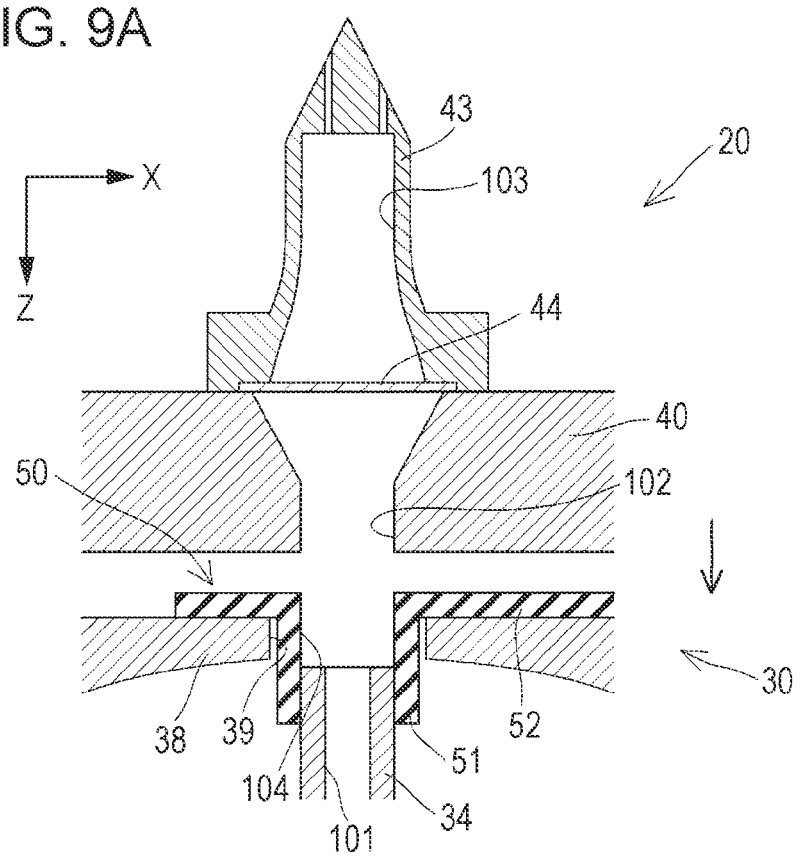
FIG. 9A and FIG. 9B are enlarged section views of a main portion of the recording head according to the second embodiment of this invention.
Figure 9B:
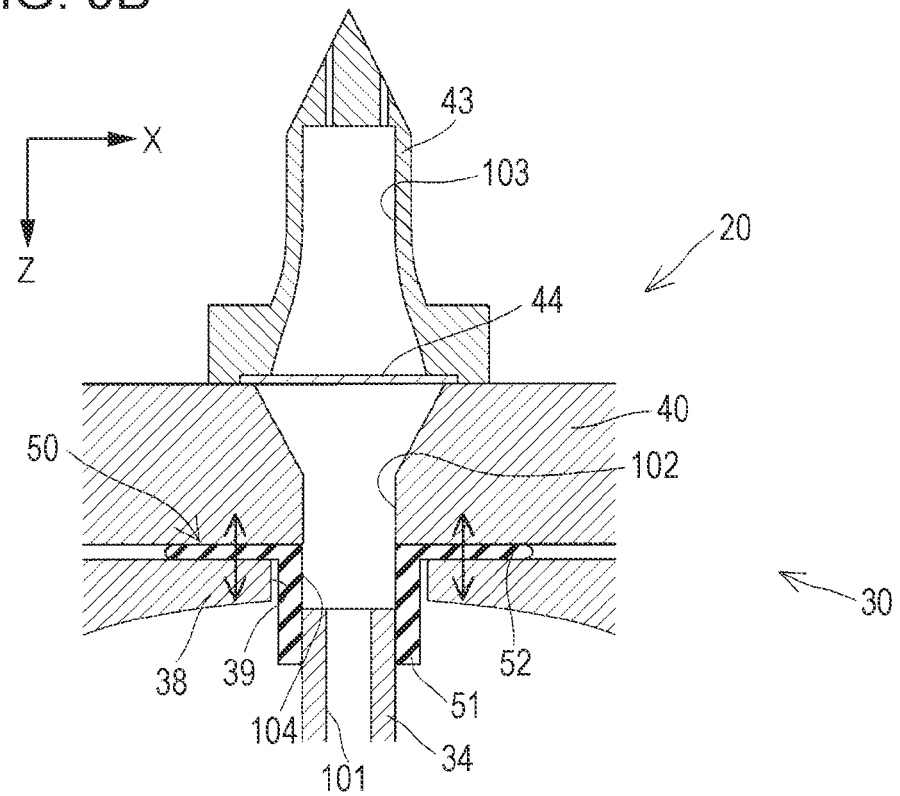

FIG. 7 is a sectional view of the ink jet recording head as an example of the liquid ejecting head according to the second embodiment of this invention. FIG. 8 is a front view of the ink jet recording head and FIGS. 9A and 9B are enlarged section views of a main portion in FIG. 7. Further, on the same elements as those of the first embodiment, the same references are assigned and duplicated explanation thereof will be omitted.

As illustrated in the drawings, the ink jet recording head 1 as an example of the liquid ejecting head of this embodiment has a plurality of head bodies 10 for ejecting ink droplets from nozzles and the flow path member 20 which holds the plurality of head bodies 10 and includes a liquid flow path for supplying liquid to the head body 10.

The flow path member 20 includes the first flow path member 30 in which the first liquid flow path 101 is provided, the second flow path member 40 in which the second liquid flow path 102 communicating with the first liquid flow path 101 is provided, the seal member 50 which is provided between the first flow path member 30 and the second flow path member 40 and seals a coupling portion between the first liquid flow path 101 and the second liquid flow path 102 and the support member 38 which is provided between the seal member 50 and the second flow path member 40.

On the first flow path member 30, the plurality of head bodies 10, in this embodiment, five head bodies 10, are set in parallel in the second direction Y.

Further, the first flow path member 30 has the first liquid flow path 101. In the first liquid flow path 101, one end is opened to a surface to which the head body 10 is fixed and the other end is opened to a surface (in the third direction Z) which is opposite to the surface where the head body 10 is fixed.

Further, the surface to which the first liquid flow path 101 is opened has the cylinder-shaped first projection portion 34. On a projected end surface of the first projection portion 34, the first liquid flow path 101 is provided to be opened.

Further, in this embodiment, as illustrated in FIG. 8, the first flow path member 30 has two first liquid flow paths 101 for one head body 10. In this embodiment, since the first flow path portion 30 has five head bodies 10, ten first liquid flow paths 101 are provided in total.

Further, the first flow path member 30 has the fixing hole 37 which penetrates through the first flow path member 30 in a thickness direction. Then, the fixing screw 60 is inserted into the fixing hole 37 and screwed with the second flow path member 40 in a state in which the fixing screw 60 is inserted into a through-hole 38*a* of the support member 38, which is described later. In this way, the first flow path member 30 is fixed to the second flow path member 40. Further, in this embodiment, the fixing hole 37 is provided on each of four corners of the first flow path member 30 and the four corners of the flow path member 20 are fixed with the fixing screws 60.

The second flow path member 40 has the liquid storage mounting portion 41 to which the liquid storage like an ink cartridge etc. for accumulating ink is coupled to the opposite side of the first flow path member 30.

Further, in the second flow path member 40, the wall portion 45 is extended at one end portion in the first direction X to the liquid storage mounting portion 41 side in the third direction Z.

In the second flow path member 40, the second liquid flow path 102 in which one end is opened to the liquid storage mounting portion 41 side and the other end is opened to the first flow path member 30 side is provided. In this embodiment, since the second liquid flow path 102 is coupled to the first liquid flow path 101 of the first flow path member 30, the same number with that of the first liquid flow paths 101, that is, ten second liquid flow paths 102 are provided.

Further, in this embodiment, a surface of the first flow path member 30 side of the second flow path member 40 to which the second liquid flow path 102 is opened is a plane surface.

Further, on a surface of the second flow path member 40 opposite to the first flow path member 30 side, that is, an opened portion of the second liquid flow path 102 of the liquid storage mounting portion 41, the needle-shaped coupling member 43 to be coupled to the liquid storage is fixed. Further, between the coupling member 43 and the second flow path member 40, the filter 44 for removing bubbles and obstacles included in ink is provided.

The coupling member 43 has a through-hole 103 communicating with the second liquid flow path 102. By the coupling member 43 being coupled to the liquid storage, ink in the liquid storage is supplied to the second liquid flow path 102 of the second flow path member 40 via the through-hole 103 of the coupling member 43. Further, in this embodiment, since an ink cartridge is used as the liquid storage, by the needle-shaped coupling member 43 being inserted into the ink cartridge, the inside of the ink cartridge and the through-hole 103 in the coupling member 43 are coupled. Further, the coupling member 43 is provided so as to correspond to the second liquid flow path 102. In this embodiment, since ten second liquid flow paths 102 are provided, ten coupling members 43 are provided, similarly to the second liquid flow paths 102.

Further, in this embodiment, the head body 10 and the first flow path member 30 correspond to the first member which ejects ink and has the first liquid flow path 101. Further, the second flow path member 40 corresponds to the second member in which the second liquid flow path 102 communicating with the first liquid flow path 101 is provided.

Further, between the first flow path member 30 and the second flow path member 40, the seal member 50 which seals a coupling portion between the first liquid flow path 101 and the second liquid flow path 102 is provided. Here, the coupling portion between the first liquid flow path 101 and the second liquid flow path 102 is, in this embodiment, a portion in which the first projection portion 34 and a surface to which the second liquid flow path 102 of the second flow path member 40 is opened face each other. When the first projection portion 34 and the second flow path member 40 are made to contact directly, there causes a gap between the first projection portion 34 and the second flow path member 40 due to dimension tolerance and so forth, or the first projection portion 34 and the second flow path member 40 abut against each other to apply pressure to the head body 10 in the third direction Z. Therefore, the top surface of the first projection portion 34 and the second flow path member 40 are arranged to be separated in advance. Further, in this embodiment, the second liquid flow path 102 and the communication path 104 of the seal member 50 are illustrated to have the same inner diameter in the drawing. However, an inner diameter of the second liquid flow path 102 may be smaller than that of the communication path 104. In this case, there is defined a gap between the first projection portion 34 and the second flow path member 40, and there is a fear of staying bubbles. Therefore, when a gap is generated between the first projection portion 34 and the second flow path member 40, a filling member may be inserted. As this filling member, porous elastomer having a liquid-resistance property against liquid such as ink and so forth which is used in the ink jet recording head 1, and a material whose elastic force (elastic ratio) is low in comparison with the seal member 50 (described later in detail) can be used. For instance, porous elastomer includes resin materials like polyethylene, melanin and so forth, and sponge made of rubber.

As the seal member 50, materials which have a liquid-resistance property against liquid such as ink and so forth used in the ink jet recording head 1 and are elastically deformable, for instance, rubber, elastomer and so forth can be used.

Such seal member 50 has the cylinder-shaped seal portion 51 and the plate-like coupling portion 52 to which the plurality of seal portions 51 are coupled. This coupling portion 52 and the seal portion 51 are coupled at one end portion of the seal portion 51 (the third direction Z).

Further, in the seal portion 51, the communication path 104 which has a slightly smaller inner diameter than the outer diameter of the first projection portion 34 is provided. Then, the communication path 104 of the seal portion 51 is fit with an outer periphery of the first projection portion 34, thereby communicating the first liquid flow path 101 provided on the first projection portion 34 with the communication path 104.

Further, the coupling portion 52 abuts against a surface to which the second liquid flow path 102 of the second flow path member 40 is opened, whereby the second liquid flow path 102 communicates with the communication path 104.

Further, the communication path 104 has a slightly smaller inner diameter than the diameter of the outer periphery of the first projection portion 34. Therefore, the inside of the communication path 104 is made to stick to an outer circumferential surface of the first projection portion 34 in a state where pressure is applied in a diameter direction of the first liquid flow path 101. Here, a diameter direction of the first liquid flow path 101 is a direction which traverses a direction of ink flow. In this embodiment, it is a surface direction along the first direction X and the second direction Y. Though the first liquid flow path 101 is provided along the third direction Z in this embodiment, this is not particularly limited thereto. For instance, the first liquid flow path 101 may be provided in a direction which intersects the third direction Z. In this case, in the seal portion 50, a diameter direction of the first liquid flow path 101 is a direction which intersects the third direction Z in which the flow path is provided.

Further, between the first flow path member 30 and the second flow path member 40, the support member 38 which supports the first flow path member 30 side of the seal member 50, that is, which abuts against the first flow path member 30 side of the seal member 50 is provided.

In this embodiment, the support member 38, which is made of a member different from the first flow path member 30, is provided. The support member 38 is supported at the fixing area side where the first flow path member 30 and the second flow path member 40 are fixed and is provided projecting toward a coupling portion between the first liquid flow path 101 and the second liquid flow path 102.

Here, as described above, the first flow path member 30 and the second flow path member 40 are fixed by screwing the fixing screw 60 that has been inserted into the fixing hole 37 of the first flow path member 30 with the second flow path member 40. Therefore, the fixing area where the first flow path member 30 and the second flow path member 40 are fixed is a portion that is fixed with the fixing screw 60, that is, an area where the fixing screw 60 is provided.

Then, when a plane where a nozzle is formed is seen from above, this fixing area is provided in a place different from the place where the nozzle is formed. In this embodiment, the fixing area is, when the liquid ejecting surface 12 is seen from above, arranged outside the liquid ejecting surface 12 where a nozzle is opened, that is, outside the head body 10. Here, since a nozzle is generally provided on a nozzle plate, for instance, when an area of the nozzle plate of the head body 10 is small and a surface of the head body 10 opposite to the surface where the nozzle plate is formed is large, if the fixing area is arranged outside the nozzle plate, the fixing area may be arranged on a position overlapping the side of the head body 10 opposite the nozzle plate.

Note that on the support member 38, as described above, the through-hole 38*a* which communicates with the fixing hole 37 of the first flow path member 30 is provided. Then, the fixing screw 60 is inserted into the fixing hole 37 of the first flow path member 30 and the through-hole 38*a* of the support member 38 to be screwed with the second flow path member 40. Thus, in the fixing area where the first flow path member 30 and the second flow path member 40 are fixed, the support member 38 is held between the first flow path member 30 and the second flow path member 40.

In this support member 38, the insertion hole 39 in which the seal portion 51 of the seal member 50 is inserted is provided. Then, by inserting the first flow path member 30 side of the seal portion 51 of the seal member 50 into the insertion hole 39 of the support member 38, the support member 38 supports (abut against) the first flow path member 30 side of the coupling portion 52 of the seal member 50.

Further, the support member 38 of this embodiment is formed so that the thickness (in the third direction Z) thereof may become gradually thick from the insertion hole 39 toward the fixing area side, that is, the fixing screw 60 side. In this embodiment, a surface on the first flow path member 30 side of the support member 38 is formed to be a curved surface. Thus, in the support member 38, stiffness is improved in a state where a space between the support member 38 and the seal member 50 is secured. Therefore, elastic deformation of an area abutting against the seal member 50 is difficult to be caused. That is, preferably, the support member 38 is made of a material whose stiffness is high and has a shape which is difficult to elastically deform. Of course, even if the support member 38 elastically deforms, since pressure generated by the support member 38 is dispersed in the fixing area as described in the first embodiment, it is possible to suppress pressure to be applied to a nozzle.

The coupling portion 52 of the seal member 50 is held between the support member 38 and the second flow path member 40 in a state where pressure is applied in the third direction Z. Thus, the second liquid flow path 102 of the second flow path member and the communication path 104 of the seal portion 51 communicate with each other in a sealed state. That is, the seal member 50, in a coupling portion with the second liquid flow path 102, performs sealing by applying pressure in a stacking direction of the first flow path member 30 and the second flow path member 40, that is, in a direction of ink flow.

Further, in the communication path 104 of the seal portion 51 that is inserted into the insertion hole 39 of the support member 38, the first projection portion 34 of the first flow path member 30 is inserted. Then, the communication path 104 and the first liquid flow path 101 communicate with each other. Thus, the first liquid flow path 101 and the second liquid flow path 102 communicate with each other via the communication path 104 and a coupling portion between the first liquid flow path 101 and the second liquid flow path 102 is sealed by the seal member 50.

Here, with respect to a coupling method of the first liquid flow path 101 and the second liquid flow path 102 will be explained with reference to FIGS. 9A and 9B.

First, as illustrated in FIG. 9A, the seal member 50 is arranged on the support member 38 in a state where the support member 38 is arranged on the first flow path member 30. At this time, by inserting the first projection portion 34 of the first flow path member 30 into the communication path 104 of the seal portion 51, the first liquid flow path 101 and the communication path 104 communicate with each other.

Next, as illustrated in FIG. 9B, the coupling portion 52 of the seal member 50 is held at a predetermined pressure between the second flow path member 40 and the support member 38. Thus, the second liquid flow path 102 of the second flow path member 40 and the communication path 104 of the seal portion 51 communicate with each other. Further, since the communication path 104 of the seal member 50 is opened to the coupling portion 52, it is possible to easily perform positioning between the second liquid flow path 102 and the communication path 104 by adjusting the relative position of the first flow path member 30 against the seal portion 51 (support member 38).

When the second liquid flow path 102 of the second flow path member 40 is provided in a cylinder-shaped projection portion (the second projection portion) to fit the seal portion 51 with an outer periphery of the second projection portion, and the second liquid flow path 102 and the communication path 104 are coupled, a plurality of second projection portions need to be inserted into the seal portion 51 simultaneously. Thus, workability becomes poor. Further, since there is a fear of the seal portion 51 shifting in an insertion direction, mounting is difficult. Further, when there causes an error between positions of the plurality of second projection portions and positions of the plurality of seal portions 51, it is necessary to deform the seal portion 51 to be bent. Therefore, there is a fear of causing failure such as ink leakage due to sealing failure. In this embodiment, planes of the coupling portion 52 and the second flow path member 40 are abut against each other to communicate the communication path 104 with the second liquid flow path 102. Therefore, positioning with each other is facilitated. Further, even if there causes an error in a position of each seal portion 51 for the plurality of second liquid flow paths 102, it is possible to reduce force in a bending direction toward the seal portion 51, thereby being capable of suppressing ink leakage due to sealing failure.

Further, by pinching the seal member 50 between the second flow path member 40 and the support member 38, the seal member 50 elastically deforms in the third direction Z to cause repulsive force. Since this repulsive force received by the support member 38, the force is dispersed into a portion which is supported by the first flow path member 30 of the support member 38. That is, the support member 38 is, when a plane where a nozzle is formed is seen from above, fixed to the first flow path member 30 at a side of a fixing area which is a place different from the place where the nozzle is formed. Therefore, the repulsive force at a place overlapping with the nozzle is dispersed into an area which is supported by the first flow path member 30 of the support member 38 (fixed area). Accordingly, it is possible to suppress the repulsive force of the seal member 50 from pressing the nozzle and the peripheral area therearound. Thus, it is possible to suppress detachment of the head body 10 from the flow path member 20, detachment of a stacking member (a member stacked in the third direction Z, not shown) which configures the head body 10, and deflection on the liquid ejecting surface 12 of the head body 10, thereby being capable of suppressing landing position shift of ink droplet ejected from the nozzle due to the deflection of the liquid ejecting surface 12 to the ink-droplet ejected medium.

Thus, in this embodiment, an area in which the supporting member 38 is supported (fixing area) is made to be different from the nozzle position. Therefore, even if pressure at the time of supporting the seal member 50 is applied to the fixing area, the support member 38 can suppress the pressure to be applied to the liquid ejecting surface 12. Here, even if an area in which the support member 38 is supported (fixing area) is within the liquid ejecting surface 12, that is, at a position which overlaps with the liquid ejecting surface 12 when seen from above, the fixing area may be arranged in a different position from the nozzle position, that is, a position which does not overlap therewith when seen from above. That is, when the fixing area where the support member 38 is supported is a position which does not overlap a nozzle position in the liquid ejecting surface 12, even if pressure is applied to the nozzle plate via the fixing area due to repulsive force (elastic force) of the seal member 50 and pressure at the time of mounting the liquid storage, if the pressure is not applied directly to the nozzle, it is possible to suppress deflection or detachment around the nozzle. Accordingly, it is possible to suppress failures such as shifting of landing position of ink droplets, and so forth to be generated.

Further, in this embodiment, since the seal member 50 seals the first liquid flow path 101 by the seal portion 51 by applying pressure in a diameter direction of the first liquid flow path 101, it is possible to increase sealing pressure by the seal member 50. Thus, it is possible to suppress ink leakage and deflection of the head body 10 (liquid ejecting surface 12).

Figure 10:
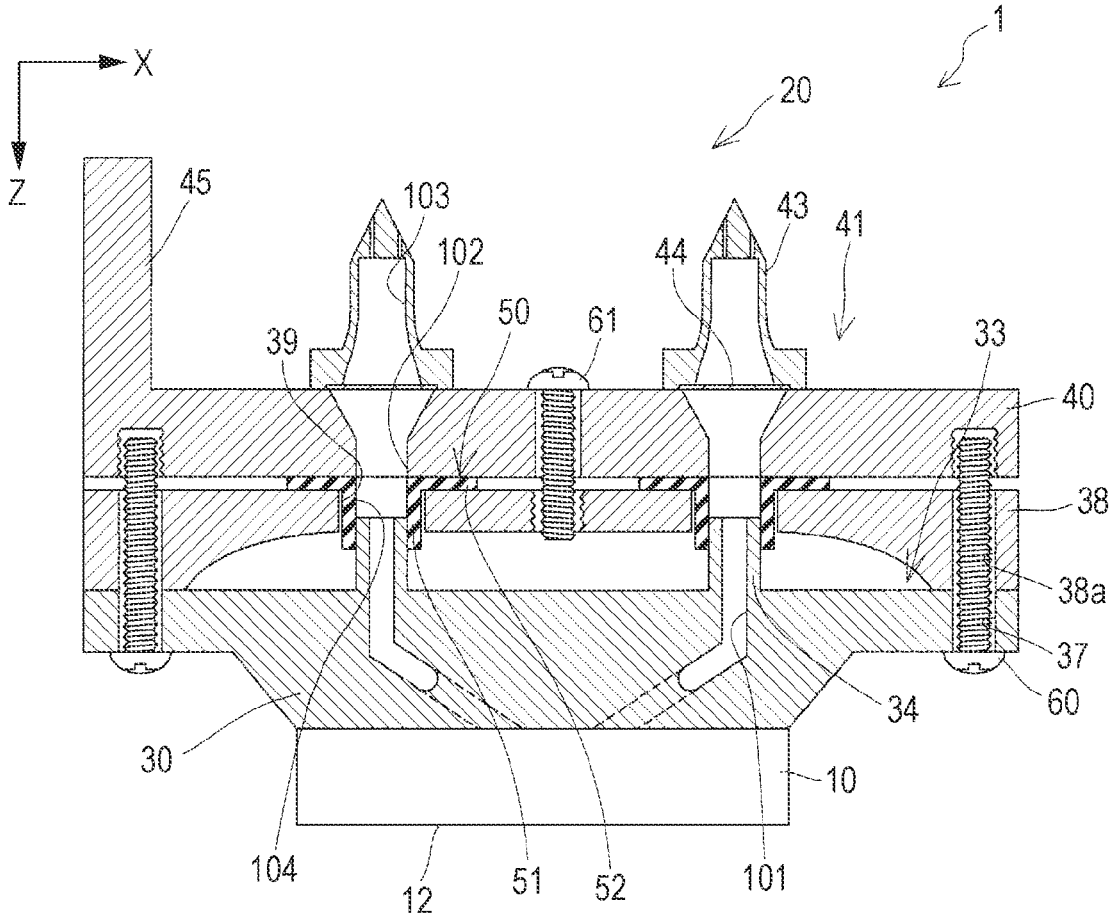
FIG. 10 is a section view of a variation of the recording head according to the second embodiment of this invention.

Further, in this embodiment, the second flow path member 40 and the support member 38 are fixed only in the fixing area where the first flow path member 30 and the second flow path member 40 are fixed. However, this is not particularly limited thereto. Here, another example is illustrated in FIG. 10. Note that, FIG. 10 is a section view which illustrates another example of the ink jet recording head.

As illustrated in FIG. 10, the second flow path member 40 and the support member 38 are fixed with a second fixing screw 61. An area that the second fixing screw 61 fixes, in this embodiment, is a position which overlaps the liquid ejecting surface 12 when a surface where a nozzle is provided (liquid ejecting surface 12, in this embodiment) is seen from above. Further, an area that the second fixing screw 61 fixes is not particularly limited if it is on an inner side than the fixing area in which the first flow path member 30 and the second flow path member 40 are fixed (a nozzle side). It may be a position which overlaps the nozzle when a surface where the nozzle is provided is seen from above.

Thus, the second flow path member 40 and the support member 38 are fixed inner than the fixing area of the first flow path member 30 and the second flow path member 40, thereby reinforcing the support member 38 due to the second flow path member 40 to improve stiffness of the support member 38. Thus, it is possible to reduce elastic deformation of the support member 38 due to repulsive force of the seal member 50.

Further, though in the example illustrated in FIG. 10, the second flow path member 40 and the support member 38 are fixed with the second fixing screw 61, this is not particularly limited thereto. They may be fixed with a split pin, a clip, and so forth. Note that the second flow path member 40 and the support member 38 are made to be detachable, thereby being capable of facilitating maintenance such as cleaning of the flow path member 20, and exchange of supplies.

Other Embodiments

Hereinabove, though each embodiment of the invention has been explained, a basic configuration of the invention is not limited to those described above.

For instance, in the above first embodiment, the seal member 50 in which a plurality of seal portions 51 are integrally provided is exemplified. However, the invention is not particularly limited thereto. The tube-shaped seal portion 51 is provided alone and the seal portion 51 itself may be a seal member. In this case, the support member may abut so as to support an end surface of the first flow path member 30 side of the seal portion 51.

Further, though in the above second embodiment, similarly, a plurality of seal portions 51 are coupled to the coupling portion 52, the invention is not particularly limited thereto. The seal portion 51 and the plate-like coupling portion consecutively coupled to the end portion may be provided independently for each flow path.

Further, though in the above each embodiment, the head body 10 and the first flow path member 30 correspond to the first member and the second flow path member 40 corresponds to the second member, this is not particularly limited thereto. For instance, the head body 10 may correspond to the first member and the flow path member 20 (the first flow path member 30 and the second flow path member 40) may correspond to the second member. That is, the seal member 50 and the support member 38 may be provided at a coupling portion between the head body 10 and the flow path member 20.

Further, though in the above each embodiment, the support member 38 abuts so as to support a surface of the first flow path member 30 side of a plate-like portion of the seal member 50 (coupling portion 52, etc.), the invention is not particularly limited thereto. For instance, the seal member 50 may abut against an end surface of the first flow path member 30 side of the seal portion 51 to support. Thus, it is possible to suppress a state in which pressure due to elastic deformation of the seal member 50 acts on the support member 38 and the nozzle.

Further, though in the above first embodiment, the support member 38 is integrally formed with the first flow path member 30, the invention is not particularly limited thereto. The support member 38 may be separated from the first flow path member 30. When the support member 38 is a different member from the first flow path member 30, the support member 38 may abut against an outer circumferential side of the first flow path member 30 and be arranged to be separated from the first flow path member 30 on a central portion side of the first flow path member 30.

Further, a sectional shape of the flow path or the seal portion is not limited to a circle. It may be various shapes such as an ellipse, a polygon, etc.

Further, configurations of the above first embodiment and the above second embodiment may be variously combined. For instance, as a configuration in which the first liquid flow path 101 of the seal member 50 of the second embodiment is sealed, a configuration as illustrated in FIGS. 5A and 5B of the above first embodiment may be adopted. That is, the seal member 50 of the second embodiment is fit with an outer periphery of the first projection portion 34 to make an inner surface of the communication path 104 of the seal member 50 stick to an outer periphery of the first projection portion 34 for sealing. The seal member 50 may be sealed by making an inner surface of the first projection portion 34 (first liquid flow path 101) stick to an outer circumferential surface of the seal member 50 (seal member 51). Further, though in the above second embodiment, with a configuration in which the second liquid flow path 102 side of the seal member 50 is sealed, pressure is applied in a direction orthogonal to the liquid ejecting surface 12, the invention is not particularly limited thereto. For instance, similar to the above first embodiment, sealing may be performed by applying pressure in a diameter direction of the second liquid flow path 102. In this case, for instance, any one of configurations as illustrated in FIGS. 1, 4A, 4B, 5A, 5B, 6A, and 6B of the above first embodiment may be adopted.

Figure 11:
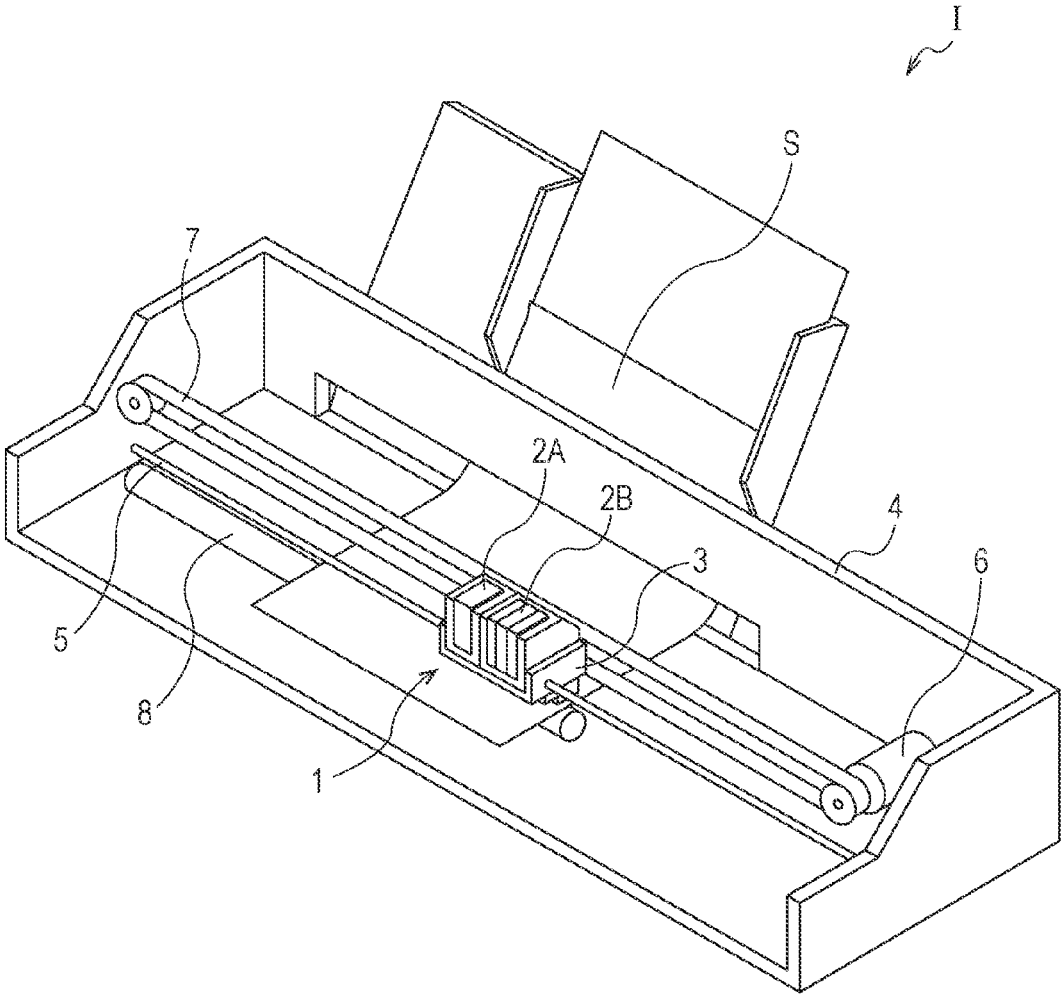
FIG. 11 is a perspective view of a schematic structure of a recording apparatus according to an embodiment of this invention.

Further, the ink jet recording head 1 in these respective embodiments is mounted on an ink jet recording apparatus. FIG. 11 is a schematic view which illustrates one example of the ink jet recording apparatus.

In the ink jet recording apparatus I as illustrated in FIG. 11, on the ink jet recording head 1, ink cartridges 2A and 2B that are liquid storages are provided detachably. Then, the ink jet recording head 1 on which the ink cartridges 2A and 2B are mounted is mounted on a carriage 3. The carriage 3 is mounted movably in a shaft direction of a carriage shaft 5 which is mounted on an apparatus body 4.

Then, by transmitting drive force of a drive motor 6 to the carriage 3 via a plurality of gears (not shown) and a timing belt 7, the carriage 3 on which the ink jet recording head 1 is mounted is moved along the carriage shaft 5. On the other hand, on the apparatus body 4, a platen 8 is provided along the carriage shaft 5 and a recording sheet S that is a recording media such as paper fed by a feeding roller (not shown) is wound around the platen 8 to be fed.

Note that in the above described ink jet recording apparatus I, the ink jet recording head 1 is mounted on the carriage 3 to be moved in a main scanning direction. However, the invention is not particularly limited thereto. For instance, the invention can be applied to a so-called line recording apparatus in which the ink jet recording head 1 is fixed and the recording sheet S such as paper is only moved in a sub-scanning direction for printing.

Further, though in the above described example, the ink cartridges 2A and 2B are exemplified as the liquid storage, the invention is not particularly limited thereto. For instance, the liquid storage like an ink tank may be fixed on the apparatus body 4 to couple the liquid storage with the ink jet recording head 1 via a supply pipe like a tube and so forth. That is, the one in which the liquid storage is directly coupled to the coupling portion 43 is not limited and the liquid storage may be coupled to the coupling member 43 via a supply pipe and so forth. Further, the liquid storage may not be mounted on the ink jet recording apparatus.

Further, the invention is directed to the full range of the liquid ejecting head. For instance, the invention can be applied to a recording head such as various kinds of ink jet recording heads that are used in an image recording apparatus like a printer, a color material ejecting head that is used for manufacture of color filters like liquid crystal display and so forth, an electrode material ejecting head that is used for formation of electrode like organic EL display, FED (Field Emission Display), and so forth, and a biological organic matter ejecting head that is used for bio chip manufacture and so forth.

What is claimed is:

1. A liquid ejecting head comprising:

a first member that has a first liquid flow path for supplying liquid to a nozzle;

a second member that has a second liquid flow path communicating with the first liquid flow path;

a seal member that seals a coupling portion between the first liquid flow path of the first member and the second liquid flow path of the second member; and a support member that projects toward the coupling portion from a fixing area, supports the seal member at a side of the support member where the coupling portion is located, and is fixed to the first member at a side where the fixing area is located, wherein the fixing area is located in a position different from a position where the nozzle is located when a plane in which the nozzle is formed is seen from above;

wherein the seal member seals the coupling portion by applying pressure in a diameter direction of the first liquid flow path; and wherein the support member and the second member are fixed at an area inner than an area in which the support member and the first member are fixed.

2. A liquid ejecting head comprising:

a first member that has a first liquid flow path for supplying liquid to a nozzle;

a second member that has a second liquid flow path communicating with the first liquid flow path;

a seal member that seals a coupling portion between the first liquid flow path of the first member and the second liquid flow path of the second member; and a support member that projects toward the coupling portion from a fixing area, supports the seal member at a side of the support member where the coupling portion is located, and is fixed to the first member at a side where the fixing area is located, wherein the fixing area is located in a position different from a position where the nozzle is located when a plane in which the nozzle is formed is seen from above;

wherein the seal member seals the coupling portion between the support member and the second member by applying pressure in a diameter direction of the first liquid flow path and in a direction which intersects a diameter direction of the second liquid flow path.

3. The liquid ejecting head according to claim 1, further comprising a head body which has a nozzle plate, wherein the fixing area is on an outside of the nozzle plate when a plane in which the nozzle is formed is seen from above.

4. The liquid ejecting head according to claim 1, wherein the fixing area is an area in which the first member and the second member are fixed to each other.

5. The liquid ejecting head according to claim 1, wherein the first member and the support member are integrated with each other.

6. The liquid ejecting head comprising:

a first member that has a first liquid flow path for supplying liquid to a nozzle;

a second member that has a second liquid flow path communicating with the first liquid flow path;

a seal member that seals a coupling portion between the first liquid flow path of the first member and the second liquid flow path of the second member; and a support member that projects toward the coupling portion from a fixing area, supports the seal member at a side of the support member where the coupling portion is located, and is fixed to the first member at a side where the fixing area is located, wherein the fixing area is located in a position different from a position where the nozzle is located when a plane in which the nozzle is formed is seen from above;

wherein the seal member seals the coupling portion by applying pressure in a diameter direction of the first liquid flow path; and wherein the first member and the support member are different members.

7. A liquid ejecting head comprising:

a first member that has a first liquid flow path for supplying liquid to a nozzle;

a second member that has a second liquid flow path communicating with the first liquid flow path;

a seal member that seals a coupling portion between the first liquid flow path of the first member and the second liquid flow path of the second member; and a support member that projects toward the coupling portion from a fixing area, supports the seal member at a side of the support member where the coupling portion is located, and is fixed to the first member at a side where the fixing area is located, wherein the fixing area is located in a position different from a position where the nozzle is located when a plane in which the nozzle is formed is seen from above;

wherein the seal member seals the coupling portion by applying pressure in a diameter direction of the first liquid flow path; and wherein the support member and the seal member are bonded with adhesive.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

15. The liquid ejecting head according to claim 6, wherein the support member and the second member are fixed at an area inner than an area in which the support member and the first member are fixed.

16. The liquid ejecting head according to claim 6, further comprising a head body which has a nozzle plate, wherein the fixing area is on an outside of the nozzle plate when a plane in which the nozzle is formed is seen from above.

17. The liquid ejecting head according to claim 6, wherein the fixing area is an area in which the first member and the second member are fixed to each other.

18. The liquid ejecting head according to claim 7, wherein the support member and the second member are fixed at an area inner than an area in which the support member and the first member are fixed.

19. The liquid ejecting head according to claim 7, further comprising a head body which has a nozzle plate, wherein the fixing area is on an outside of the nozzle plate when a plane in which the nozzle is formed is seen from above.

20. The liquid ejecting head according to claim 7, wherein the fixing area is an area in which the first member and the second member are fixed to each other.

* * * * *